US006497619B2

(12) United States Patent
Dowdy et al.

(10) Patent No.: US 6,497,619 B2
(45) Date of Patent: Dec. 24, 2002

(54) SCORING APPARATUS FOR SIMULATED COMBAT

(76) Inventors: David D. Dowdy, 401 Minnesota Ave., Satsuma, FL (US) 32189; Frederick J. Velasco, 2236 Daisy St., Middleburg, FL (US) 32068

( * ) Notice: Subject to any disclaimer, the term of this patent is extended or adjusted under 35 U.S.C. 154(b) by 0 days.

(21) Appl. No.: 09/851,794

(22) Filed: May 9, 2001

(65) Prior Publication Data

US 2001/0051542 A1 Dec. 13, 2001

Related U.S. Application Data

(60) Provisional application No. 60/208,525, filed on Jun. 1, 2000.

(51) Int. Cl.[7] ..... A63H 33/30

(52) U.S. Cl. ..... 463/47.2; 434/11; 446/473; 482/12

(58) Field of Search ..... 434/11; 482/12, 482/83, 84, 109; 446/473; 463/47.2

(56) References Cited

U.S. PATENT DOCUMENTS

| | | | | |
|---|---|---|---|---|
| 1,276,959 | A | * | 8/1918 | Riebe |
| 3,516,662 | A | | 6/1970 | Keunstler, Jr. |
| 4,254,951 | A | | 3/1981 | De Laney |
| 4,462,593 | A | | 7/1984 | Carty, Jr. |
| 4,642,835 | A | * | 2/1987 | Schmitz |
| 4,817,942 | A | * | 4/1989 | Begon |
| 5,148,571 | A | * | 9/1992 | Brazis et al. |
| 5,174,756 | A | | 12/1992 | Taylor |
| 5,181,875 | A | * | 1/1993 | Hasegawa |
| 5,295,926 | A | | 3/1994 | Tanabe |
| 5,570,881 | A | | 11/1996 | Lau |
| 5,598,596 | A | * | 2/1997 | Jones et al. |
| 5,669,836 | A | * | 9/1997 | Hill |
| 6,036,602 | A | | 3/2000 | Abbott |

OTHER PUBLICATIONS

Black Belt magazine, Oct./Nov. 1983, p. 82, advertisement. No Lie Blades—the Training Blade That Doesn't Lie, http://www.nolieblades.com/Aboutus.html, http://www.nolieblades.com/Training.html, http://www.nolieblades.com/Products.html, Apr. 22, 2002.

* cited by examiner

*Primary Examiner*—William M. Pierce
(74) *Attorney, Agent, or Firm*—Jeffrey C. Maynard

(57) ABSTRACT

A scoring system is disclosed which allows for safe, accurate scoring during simulated combat situations. The scoring system includes a simulated striking apparatus having a marking means to safely deliver an erasable marking agent when the striking apparatus contacts an opponent. The striking sections of the apparatus are buffered by a soft, resilient material to reduce the impact from a striking type blow. The scoring system further includes an eraser and a body covering allowing marks from the striking apparatus to be easily seen and readily erased.

19 Claims, 8 Drawing Sheets

SCORING APPARATUS FOR SIMULATED COMBAT

This Application claims the benefit of U.S. Provisional Application, Ser. No. 60/208,525 entitled Simulated Combat Safety Sword/Knife, filed with the U.S. Patent and Trademark Office on Jun. 1, 2000.

BACKGROUND OF THE INVENTION

1. Field of the Invention

This invention relates to hand held simulated weapons such as those used in martial arts and fencing competitions, and more specifically to a scoring apparatus including a simulated edged weapon embodying a marking means that safely delivers an erasable marking agent when the weapon contacts an opponent allowing for the accurate counting of any points (hits) scored and further including a body covering allowing marks from said weapon to be easily seen and readily erased.

2. Background of the Prior Art

For centuries, martial artists have trained and competed with non-projectile hand held weapons. Some examples of such weapons are swords, foils, daggers, nunchaku, bostaff, tonfa, kama, and escrima sticks.

In their original form these weapons are composed of harsh materials such as hard wood, metal and bone, even when sharp edges were dulled and points were blunted, martial artists still found it difficult to safely train and compete with these kinds of weapons without the possibility of serious injury.

The safety issue has been partially solved by several inventions having disclosed simulations of some of these weapons composed of kinder materials such as plastics, rubbers, and closed cell foam. However, while these inventions have provided safer versions of the aforementioned weapons, none have disclosed a simulated edged weapon that combines shock absorption with a retentive/dispersive cord storing a powder marking agent, which would allow for safe, reliable hit confirmation by delivering an erasable linear mark onto an opponent.

Originally, point (hit) confirmation was always subject to human error since a judge or judges were required to observe and record any points (hits) scored when one opponent's weapon made contact with another opponent's body (target area) during training or competition. Several inventions have taken various approaches to try to solve the problem of hit confirmation. For example, present systems provide scoring equipment for a sword contest/sport in which the scoring equipment is attached to a user's arms. The scoring equipment includes a mechanism that immobilizes a user's arm when a trigger-lever mechanism is hit by a striking weapon. While this system does provide reliable hit conformation it is very expensive to manufacture and not affordable to the average practitioner.

Another current system for hit confirmation includes an electrical fencing point devise attached to the end of a fencing blade. When the electrical fencing point device contacts an opponent's metallic vest to complete a circuit, an electrical scoring apparatus connected to the electrical fencing point device automatically registers a hit. However, the connecting wires necessary to operate this specific system tend to greatly restrict the mobility of the user and inadequately assess the accuracy of an opponent hit.

An old system from the early nineteen hundreds describes a fencing implement with a padded tip containing a powder dispensing device attached to the end of a staff. When the staff is thrust against an opponent, powder is expelled from a hole in the dispensing device. This system is susceptible to clogging of the powder dispenser and is designed only for thrusting and simulating puncture wounds.

Yet another system provides an apparatus for simulating a sharp edged weapon including a means for holding and applying ink onto an opponent upon a "hit." The design of this apparatus suffers from several weaknesses. The instrument's design does not lend itself to the use of a powder marking agent nor does the invention suggest the use of a powder agent in lieu of ink. In particular, the application of the marking agent depends on capillary action to carry the liquid ink marking agent from the holding section to the application section. Additionally, this system makes no provision for any type of shock absorption for the recipient of the "hit."

All the present inventions provide semi-adequate solutions for either shock absorption or hit confirmation. Nevertheless current simulated weapons and scoring apparatuses suffer from a number of disadvantages: Specifically, simulated weapons having a marking means but lacking any form of shock absorption for the sparers are very dangerous in a full contact competition.

Often, where ink is used as a marking agent, its marking consistency is unpredictable, and being liquid, it is vulnerable to drying out prematurely in hot or windy conditions. Moreover, simulated weapons having a marking means which uses a marking agent that is non-erasable can cause confusion when previous marks scored in a past event are still visible in a current event.

Simulated swords with padded striking sections that possess round core rods are limited in flexibility, and offer poor shock absorption when encased by a padded material because the round core rod does not provide equal support for the padded encasement. Therefore, most of any shock absorbing benefit from the padding is lost when the striking section meets with an impact. In addition, simulated swords that provide for only forward shock absorption or only for diagonal shock absorption limit what kinds of strikes a practitioner may perform.

Many present systems for scoring during simulated combat are very expensive and difficult to manufacture and maintain, while making no provision for readily erasing a mark.

SUMMARY OF THE INVENTION

The present invention overcomes the above-referenced shortcomings by teaching a system and method for attaching a retentive/dispersive cord using a powder marking agent onto a variety of simulated weapons. The system includes apparel constructed of material, which allows marks from a powdered agent to be easily seen and readily erased.

Accordingly, an object of the invention is to provide a scoring apparatus with a sword embodiment having a padded striking section with a marking means that includes a powder retentive/dispersive cord attached to the striking section allowing a linear mark representing a cut to be safely dispensed upon an opponent.

Another object of the invention is to provide a scoring apparatus whose marking means includes a porous cotton cord allowing for maximum retention of a powdered marking agent providing multiple marks before requiring more powder.

Yet another object of the invention is to provide a scoring apparatus with a toy sword embodiment whose marking means includes a means for attaching a powder retentive/dispersive cord to a padded striking section which will allow the flexible cord to remain aligned and raised along the padded striking section even when subjected to repeated impacts.

Another object of the invention is to provide a scoring apparatus including a vest covered with a material that allows marks from a powdered marking agent to be easily and readily erased.

Still another object of the invention is to provide a scoring apparatus with a sword embodiment whose striking section possesses a flat rectangular core attached perpendicular to the handle which gives superior flexibility when met with an impact and also provides equal support and maximum shock absorption when laminated or encased with a padded material.

Another object of the invention is to provide a scoring apparatus with a sword embodiment that possesses both forward and diagonal shock absorption while retaining lateral stiffness for parrying type actions.

An additional object of the invention is to provide a scoring apparatus with a knife embodiment whose marking means includes a rigid blade section having a powder retentive/dispersive cord which can be stretched and secured across the blade section allowing the cord to be easily removed and replaced when worn.

Another object of the invention is to provide a scoring apparatus that is affordable, easy to manufacture and maintain.

A further object and advantage of the present invention is to provide a simulated weapon with marking means including an erasable marking agent which can be used by police and military personnel in defensive training drills where only one of two opponents is armed with the simulated weapon while the other utilizes defensive techniques whose success or failure will be made evident by the marks or absence of marks on the defender.

Still further objects and advantages will become apparent from a careful consideration of the ensuing description and drawings.

BRIEF DESCRIPTION OF THE DRAWINGS

These and other features, aspects and advantages of the present invention will become better understood with reference to the following description, appended claims, and accompanying drawing, where:

DETAILED DESCRIPTION

Figure 1A:
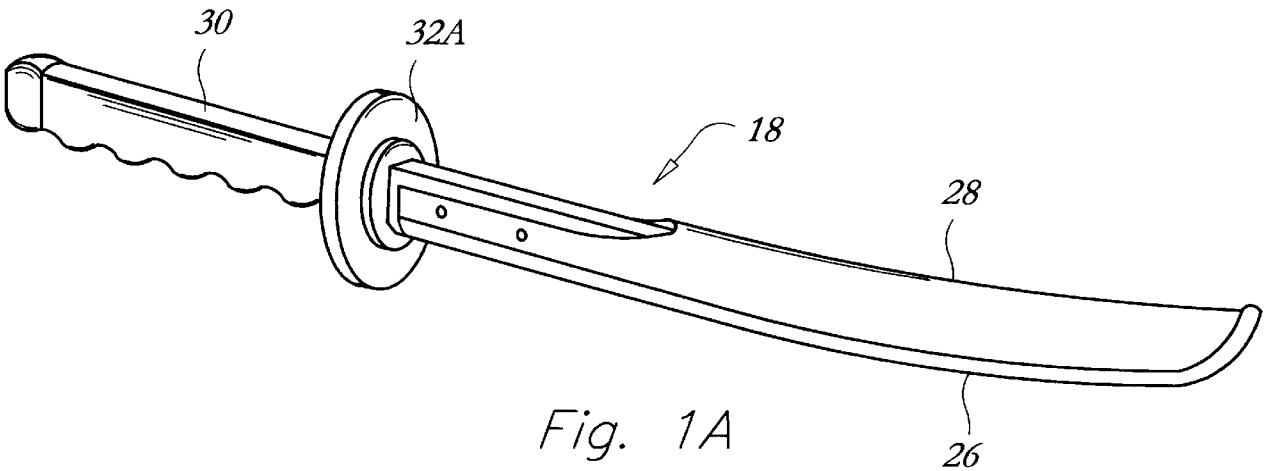
FIG. 1A is a perspective view of a simulated weapon according to the present invention.

The invention summarized above and defined by the enumerated claims may be better understood by referring to the following detailed description, which should be read in conjunction with the accompanying drawings. This detailed description of a particular preferred embodiment, set out below to enable one to practice the invention, is not intended to limit the enumerated claims, but to serve as a particular example thereof. Those skilled in the art should appreciate that they can readily use the concepts and specific embodiment disclosed as a basis for modifying or designing other methods and systems for carrying out the same purposes of the present invention. Those skilled in the art should also realize that such equivalent methods and systems do not depart from the spirit and scope of the invention in its broadest form.

The present invention, indicated generally at FIG. 1A through FIG. 1E, is a method of hit confirmation comprising a simulated edged weapon 18, a marking agent applicator 20, a body covering 22A, and an eraser 24. In use, marking agent applicator 20 directly applies chalk marking agent 20A to retentive/dispersive material 26, which is attached to striking section 28 of simulated weapon 18. When one opponent, using simulated weapon 18, strikes another opponent as shown in FIG. 1F, preferably wearing body-covering 22A, marking agent 20A is then dispersed onto body covering 22A, thereby revealing a mark in the exact area of impact. Eraser 24 is then used to wipe away marking agent 20A thereby eliminating any confusion from a past mark being mistaken for a mark from a current strike.

Simulated weapon 18, as seen in FIG. 1A, comprises striking section 28 and a gripping section 30 being divided by a hand guard 32. A chalk retentive/dispersive material 26 is attached to striking section 28.

Figure 1C:
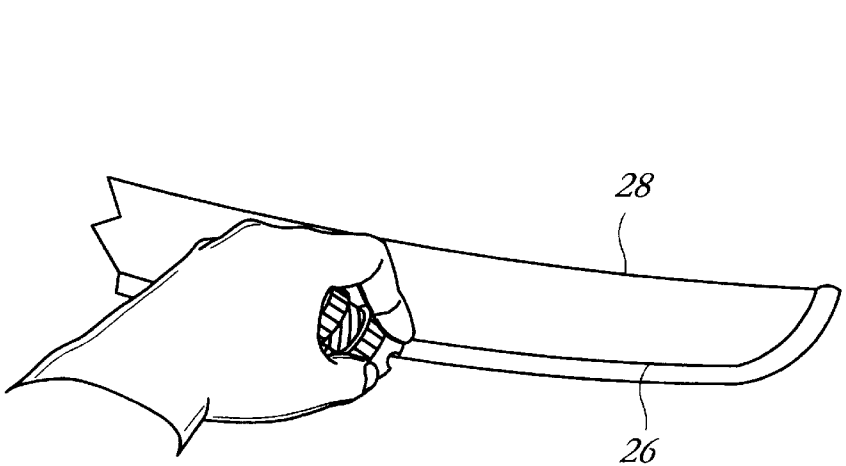
FIG. 1C is a perspective view of the applicator of FIG. 1B containing a preferred marking agent according to the present invention being applied to the simulated weapon of FIG. 1A.
Figure 1B:
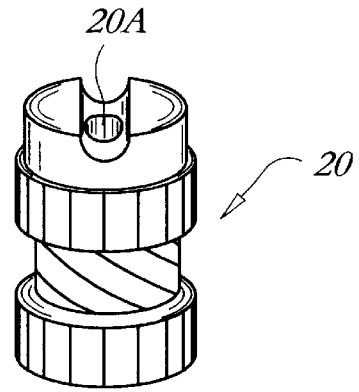
FIG. 1B is a perspective view of a marking agent applicator according to the present invention.

FIGS. 1B and 1C illustrate a marking agent applicator 20. According to the present invention, marking agent applicator 20 preferably applies chalk marking agent 20A to retentive/dispersive material 26, which is attached to striking section 28 of simulated weapon 18. Marking agent applicator 20 is illustrated in more detail in FIG. 11 and further described in detail in the following paragraphs.

Figure 1D:
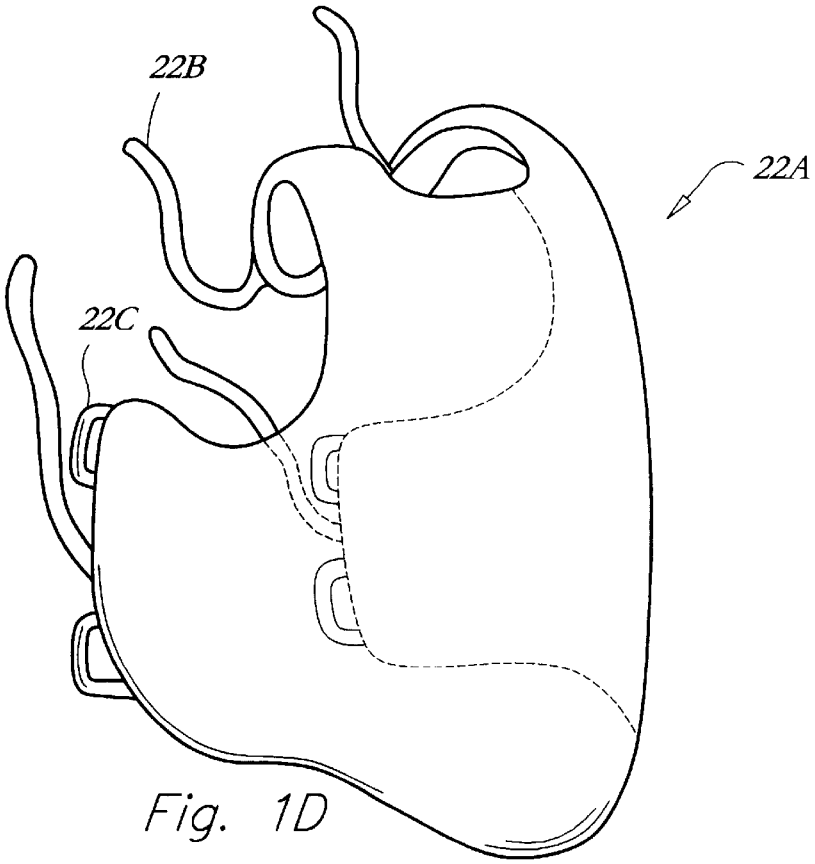
FIG. 1D is a perspective partial phantom view of a chest covering according to the present invention.
Figure 1F:
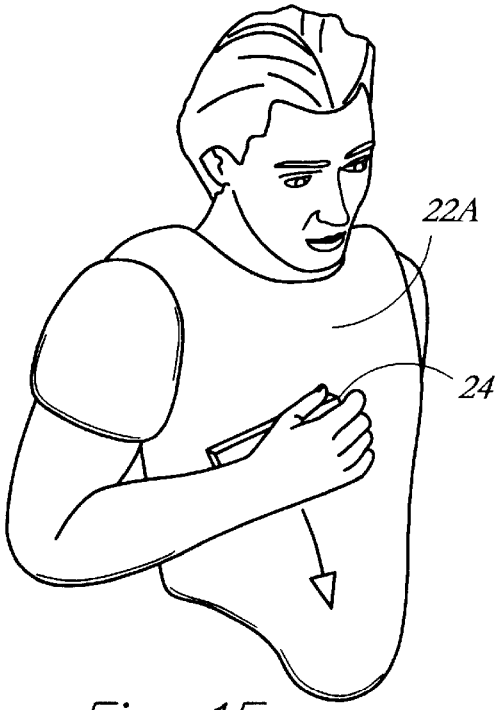
FIG. 1F is a perspective view of an opponent wearing the chest covering of FIG. 1D using the eraser of FIG. 1E to erase a mark made from a simulated weapon according to the present invention.

Body covering 22A, as seen in FIG. 1D, is a chest covering which is attached to a user's body by the tying of straps 22B to loops 22C. A material preferably used in constructing body covering 22A includes a heavy type of 100% nylon that provides the proper combination of mark absorption and erasability to permit marking agent 20A to be readily erased after a hit from simulated weapon 18 has been confirmed. Other body coverings (not shown) such as, but not limited to, hand and forearm coverings may also be used.

Figure 1E:
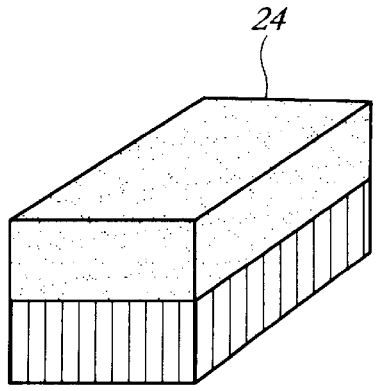
FIG. 1E is a perspective view of an eraser according to the present invention.

Eraser 24, as seen in FIG. 1E, is preferably a lamination of a sponge material and a felt material. In use, the sponge portion of eraser 24 is dampened lightly and used to wipe away any old marks from retentive/dispersive material 26 off of body covering 22A. The felt portion is then used to dry any remaining dampness from body covering 22A, thereby leaving body covering 22A clean and ready to receive new marks.

While the simulated weapon of FIG. 1A is defined as a sword type weapon and uses chalk retentive/dispersive material 26 fashioned into a cord in order to disperse linear type marks, many other striking type weapons such as, but not limited to, nunchaku, bostaff, and escrima sticks, can make use of the aforementioned method of hit confirmation of the present invention by fashioning various shaped pieces of a chalk retentive/dispersive material such as but not limited to circles, ovals, and squares (not shown) and then attaching said pieces to their striking sections.

Figure 2:
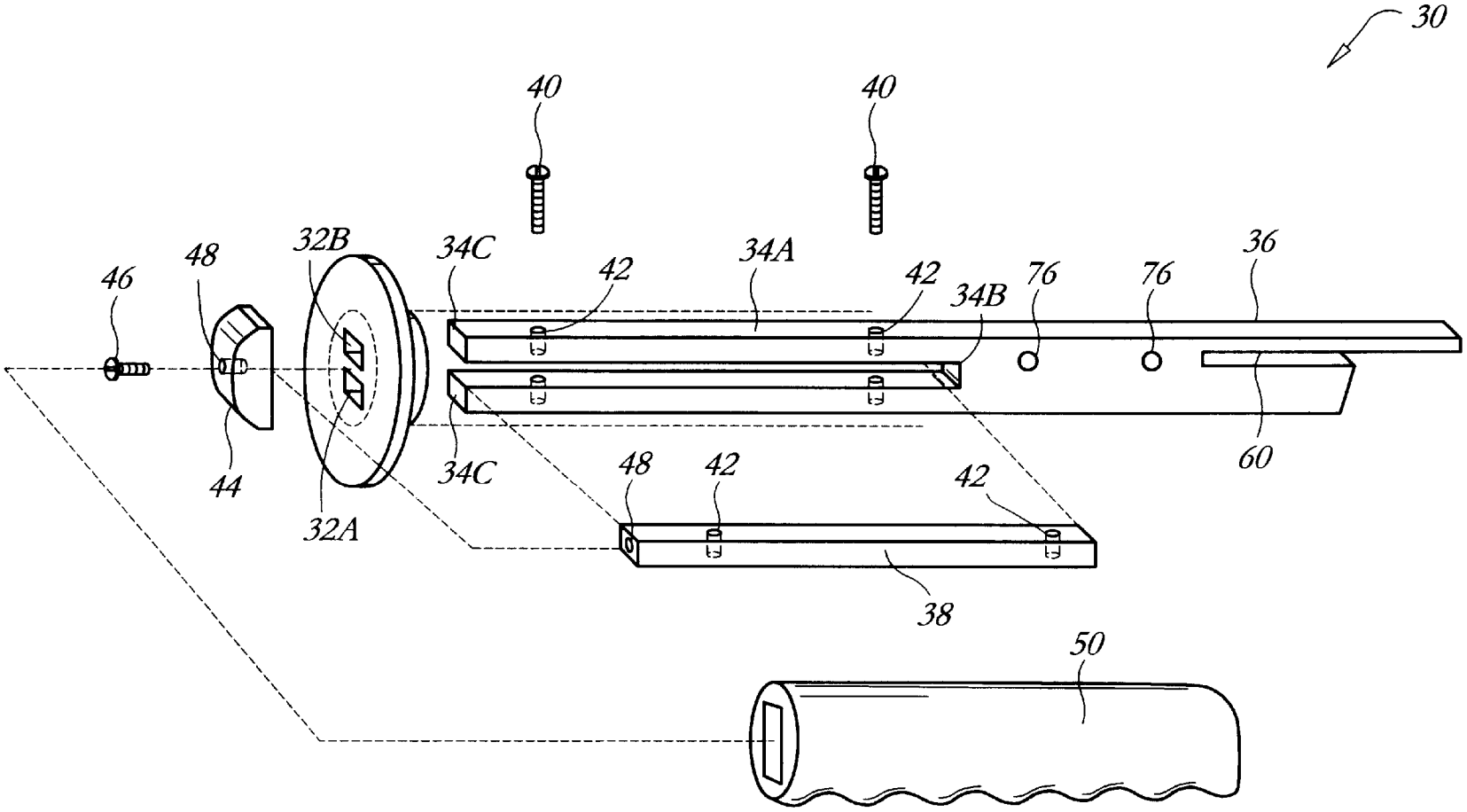
FIG. 2 is a perspective exploded view of the handle section of the simulated weapon of FIG. 1A.

FIG. 2 illustrates an embodiment of the present invention, in particular specific components of simulated weapon 18. According to the present invention, gripping section 30 preferably comprises tang 34A and tang slot 34B where by two prong fork 34C is made which accepts hand guard 32A by placing fork 34C through hand guard holes 32B, guard 32A is pushed forward to the end of slot 34B. Hand guard stabilizer 38 is inserted into slot 34B and held in place by screwing tang screws 40 into tang screw holes 42. This assembly firmly holds guard 32A in place. As seen in FIG. 1A, guard 32A thickness steps down into a smaller circumference on its forward face. This allows 32A to retain sufficient thickness for lateral stability while reducing its overall mass and weight.

With guard 32A and stabilizer 38 in place, hand gripper 50 slips onto the rear of tang 34A and is pushed up against guard 32A. In an embodiment of the present invention, end cap 44 is held onto the rear of tang 34A by screwing cap mount screw 46 through screw hole 48. Alternatively, end cap 44 may be attached onto the rear of tang 34A by other means such as welding, and the like.

Figure 3:
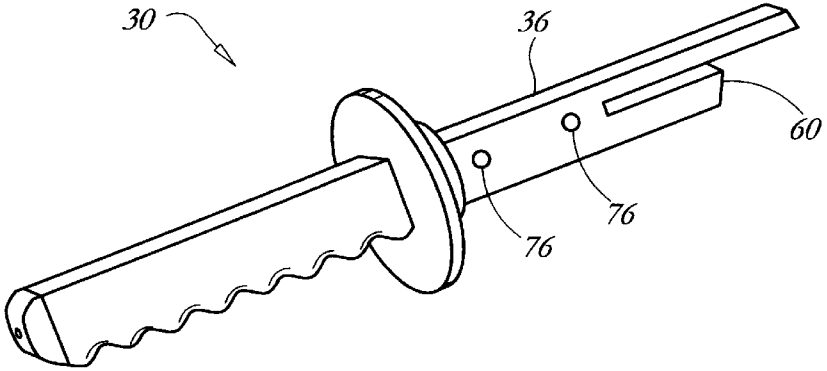
FIG. 3 is a perspective view of the gripping section of the simulated weapon of FIG. 1A.

Extending out at the forward end of gripping section 30 is spine 36. As seen in FIG. 3, forward of guard 32A is spine 36. Directly below spine 36 is a slot, which makes connection joint 60. Approximately half way back into joint 60, the front bottom portion of gripping section 30 is cut away to preferably allow a means for joint connection to a striking section of a simulated sword. Joint connection means may include screws 62 to pass perpendicularly up into spine 36.

Gripping section 30 can be, but is not limited to, being made from plastic, rubber, wood, metal or any combination thereof. Hand gripper 50 may be a one-piece sleeve made of one of the aforementioned materials. In an alternate embodiment of the present invention, gripping section 30 is wrapped with a gripping tape.

Figure 4B:
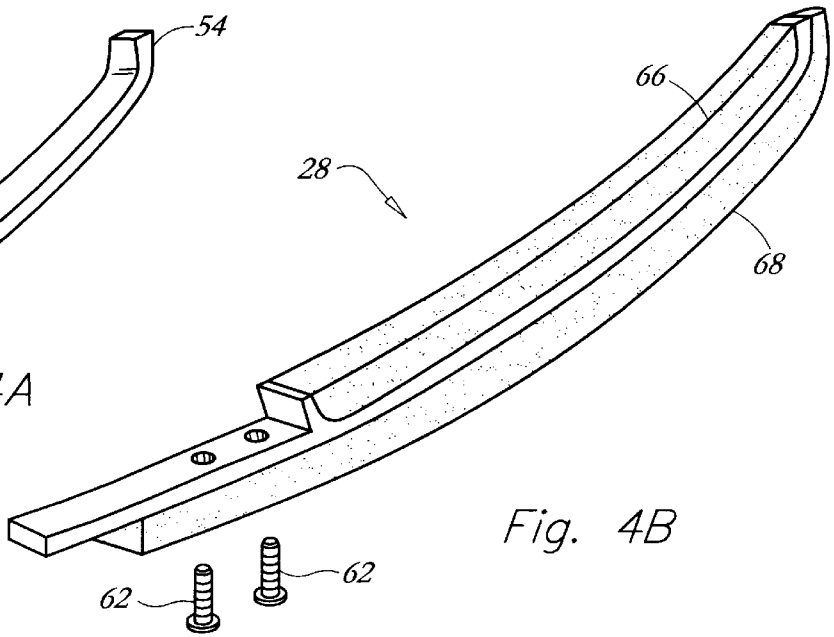
FIG. 4B is a perspective view of a striking section according to the present invention.
Figure 4A:
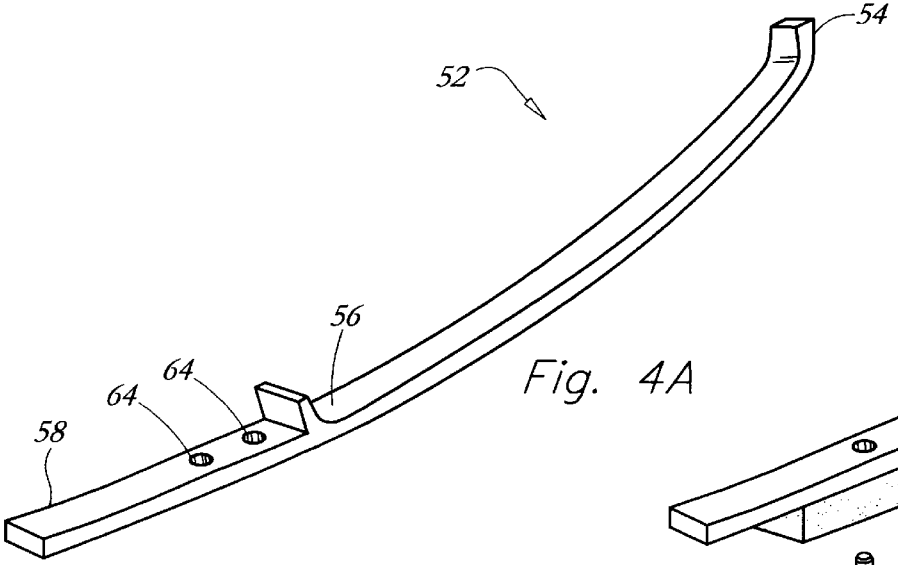
FIG. 4A is a perspective view of a core element according to the present invention.

Striking section 28, as seen in FIG. 4A and FIG. 4B, comprises rectangular core 52, being a flat, elongated, flexible member preferably made from such matter as polycarbonate plastic composition, or the like. FIG. 4A illustrates core member 52 including a forward end raises sharply into blunted tip 54. Rearward approximately two thirds of core 52 is raised rear radius 56. Rear radius 56 adds strength to core 52 when flexing from a striking or thrusting type action. Rearward of raised radius 56 is connection plate 58.

FIG. 4B illustrates a preferable construction of striking section 28 and the means for attaching striking section 28 to gripping section 30 (FIG. 3). Attached to the top and bottom of core member 52 is top padded strip 66 and bottom padded strip 68 to form striking section 28. Strip 68 is thicker than strip 66 since it bears much of the burden of an impact from a striking type blow. Strips 66 and 68 can be, but are not limited to being made from closed cell foam or other type of soft, resilient material. A preferred method for attaching strips 66 and 68 to core member 52 is with a bonding agent, such as, but not limited to contact cement Connection plate 58 of core member 52 is inserted in join 60 of gripping section 30 to form simulated weapon 18. In an embodiment of the present invention, core member 52 is attached to spine 36 by screws 62 through screw holes 64. Other attachment means may be used.

Figure 6:
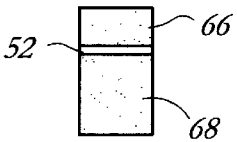
FIG. 6 is a cross sectional view of the striking section of FIG. 4B.
Figure 5:
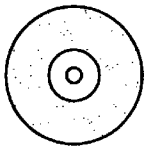
Fig. 5 Prior Art
FIG. 5 is a cross sectional view of a prior art striking section.

FIGS. 5 and 6 illustrate a cross section of a Prior Art striking section and a cross sectional view of the present invention for the purpose of comparison. Prior art suggests a round core having evenly distributed padding surrounding the core. As shown, a thicker section of padding 68 can be attached to the striking section of the present invention having rectangular, flat core 52, versus the round core of Prior Art. During an impact, flat core 52 more equally distributes the impact energy through the padding compared to the round core of Prior Art.

Figure 7:
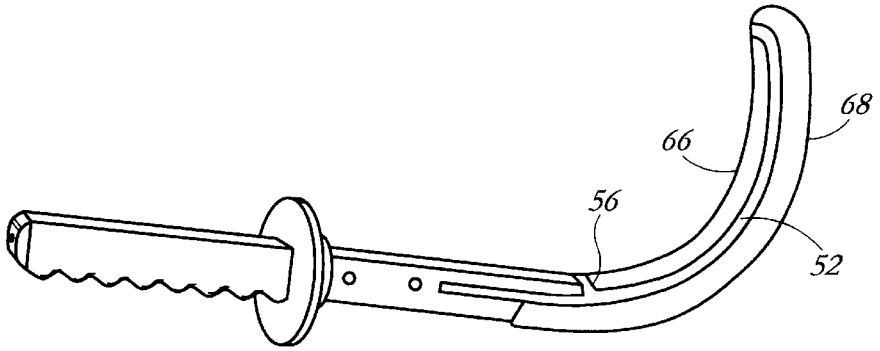
FIG. 7 is a side view of the simulated weapon of FIG. 1A showing its range of flexibility.

As seen in FIG. 7, core 52 preferably has a range of flexibility to bend during simulated combat. Core 52 preferably has a superior range of flexibility to provide maximum shock absorption during a striking or thrusting type action, yet remaining laterally stiff during a parrying type action.

Figure 8A:
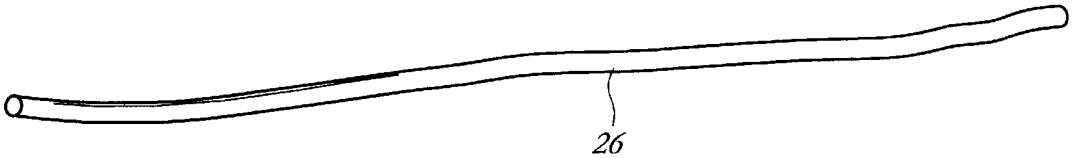
FIG. 8A is a perspective view of a powder retentive/dispersive material according to the present invention.

Retentive/dispersive material 26, as seen in FIG. 8A, is an elongated section of material fashioned into the form of a cord. Material 26 is preferably made from a cotton weave or other soft, porous material that is capable of retaining and dispersing a marking agent such as chalk agent 20A. While retentive/dispersive material 26 is preferred, in an alternate embodiment, felt like material (not shown) could also be used with limited results.

Figure 8B:
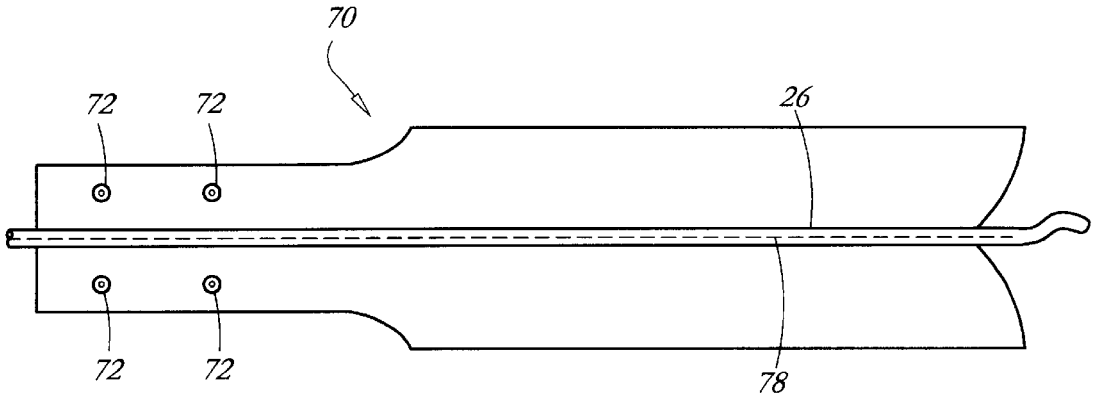
FIG. 8B is an open view of a covering according to the present invention with the retentive/dispersive material of FIG. 8A attached.

As seen in FIG. 8B striker covering 70 is shown in an open view with material 26 preferably sewn onto the center portion of covering 70 by stitching 78.

Figure 9:
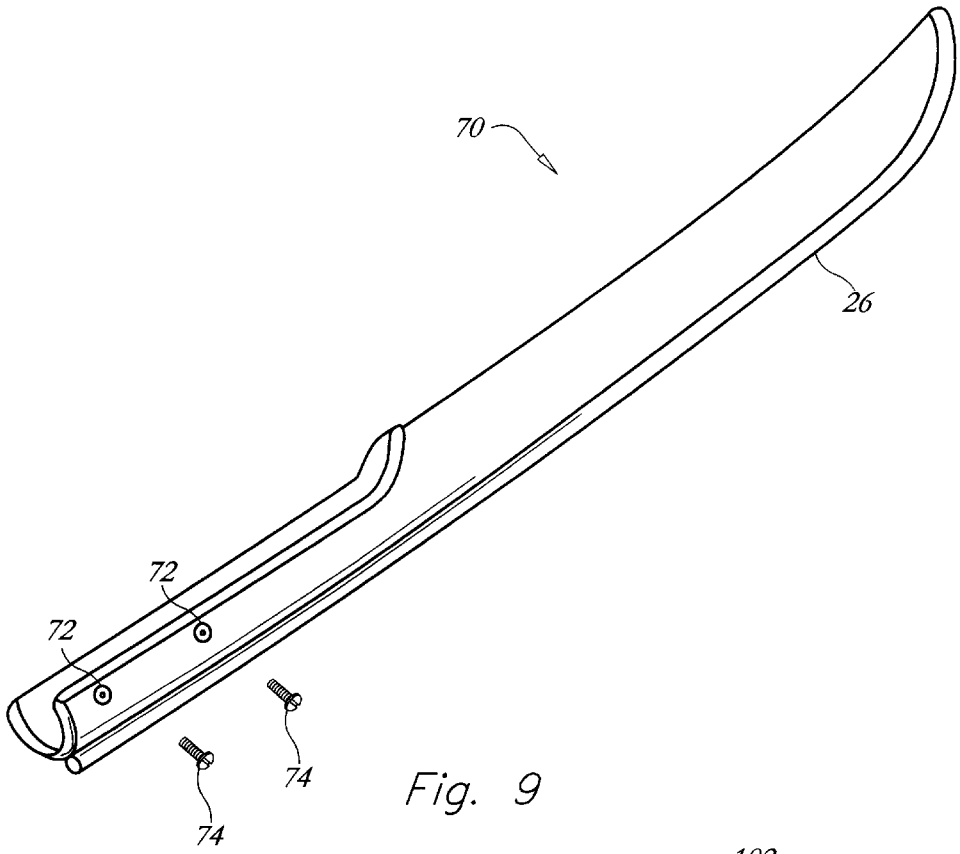
FIG. 9 is a perspective view of the covering of FIG. 8B when stitched closed.

FIG. 9 shows material 26 attached to covering 70 being stitched closed in the form of a sock fashioned to fit the shape of striking section 28. Covering 70 along with material 26 is slipped on and secured to the striking section 28 of the simulated weapon of FIG. 7 by screwing connection screws 74 through eyelets 72 and into connection screw holes 76 (FIG. 3).

Figure 10:
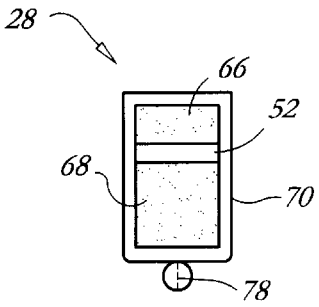
FIG. 10 is a cross sectional view of the covering of FIG. 9 when on the striking section of FIG. 6.

Covering 70 provides a means for attaching material 26 to striking section 28 as seen best in the cross section view of FIG. 10. The removable covering 70 also provides a means for replacing retentive/dispersive material 26 when worn. In an alternate embodiment of the present invention, covering 70 is extended to encompass the entire simulated weapon and is not removable (not shown). Covering 70 can be, but is not limited to, being made of vinyl or nylon.

Figure 15:
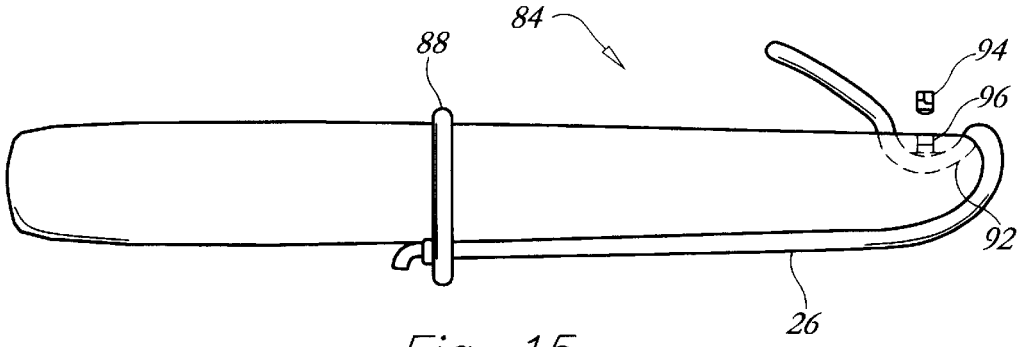
FIG. 15 is a side partial phantom view of an alternate embodiment of a simulated edged weapon with an alternate attachment method of the powder retentive/dispersive material FIG. 8A.

Another embodiment of the present invention is shown in FIGS. 15 through 18. As shown in FIG. 15, simulated weapon 84 is a non-shock absorbing embodiment comprising a handle and blade section divided by rim 88. Retentive/dispersive material 26 is slipped through cord passageway 92 and preferably held in place by setscrew 94 threaded into hole 96.

Figure 16:
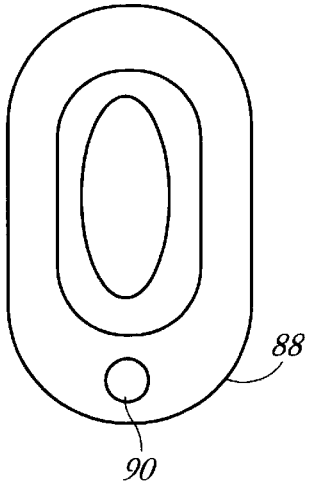
FIG. 16 is a cross sectional view of the simulated edged weapon of FIG. 15 before attaching the powder retentive/dispersive material of FIG. 8A.

FIG. 16 illustrates rim 88 having rim hole 90 to which material 26 (FIG. 15) passes through hole 90. In use, retentive/dispersive material 26 is tied off in a knot larger than hole 90 to anchor one end of retentive/dispersive material 26.

Figure 17:
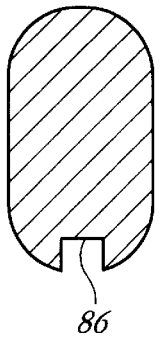
FIG. 17 is a cross sectional view of the blade section of the simulated edged weapon of FIG. 15 before attaching the powder retentive/dispersive material of FIG. 8A.

FIG. 17 illustrates a cross section of a groove 86 that is located on the upper, distal portion of simulated weapon 84. Retentive/dispersive material 26 lays in groove 86 passing up and over the tip portion of simulated weapon 84 (FIG. 15). Retentive/dispersive material 26 is then inserted through cord passageway 92 and locked down by setscrew 94 threading into hole 96. Any excess portion of retentive/dispersive material 26 is cut away to be even with the top of simulated weapon 84. Simulated weapon 84 can be, but is not limited to being made from a rubber or plastic composition. The main structural body of simulated weapon 84 is preferably milled or molded as a one-piece unit.

Figure 18:
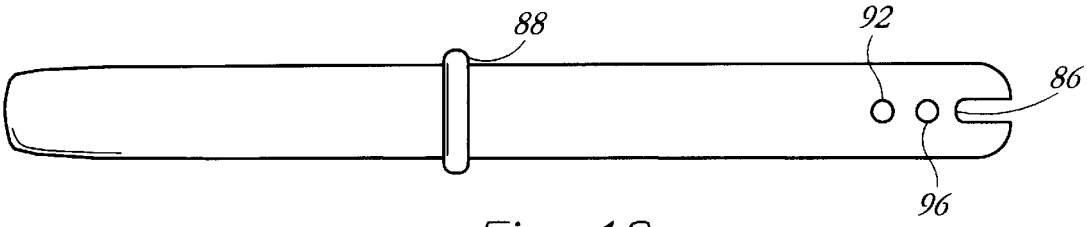
FIG. 18 is a top view of the simulated edged weapon of FIG. 15 before attaching the powder retentive/dispersive material of FIG. 8A.

FIG. 18 illustrates a top view of simulated weapon 84. Simulated weapon 84 includes rim 88. Groove 86 permits retentive/dispersive material 26 to lie securely against simulated weapon 84. Retentive/dispersive material 26 is inserted through passageway 92 and preferably held down securely by inserted threaded screw 94 through hole 96.

Figure 11:
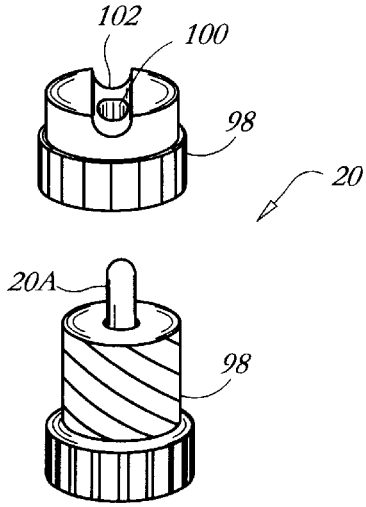
FIG. 11 is a perspective partial phantom view of the applicator of FIG. 1C.

FIG. 11 illustrates a marking agent applicator 20 comprised of applicator holder 98 and a threaded nipple with a hollow center holding stick chalk marking agent 20A in a poised position. Applicator cap with center hole 100 is screwed down onto holder 98 thereby revealing the tip portion of agent 20. In use, applicator 20 is firmly situated on cord retentive/dispersive material 26 by applicator cap groove 102, and then applicator 20 is urged back and forth across material 26 (FIG. 1C) thereby charging retentive/dispersive material 26 with marking agent 20A. While applicator 20 provides an effective guided method of charging retentive/dispersive material 26, chalk marking agent 20A can of course be used independently to recharge material 26. Applicator 20 can be but is not limited to being made of a plastic composition or metal alloy. Applicator 20 is also adaptable to accept other marking agents, such as, but not limited to a colored wax stick.

While the aforementioned embodiments are designed primarily with adults in mind, we also anticipate the need for a toy version in order to satisfy the curiosity of younger enthusiasts.

Figure 12:
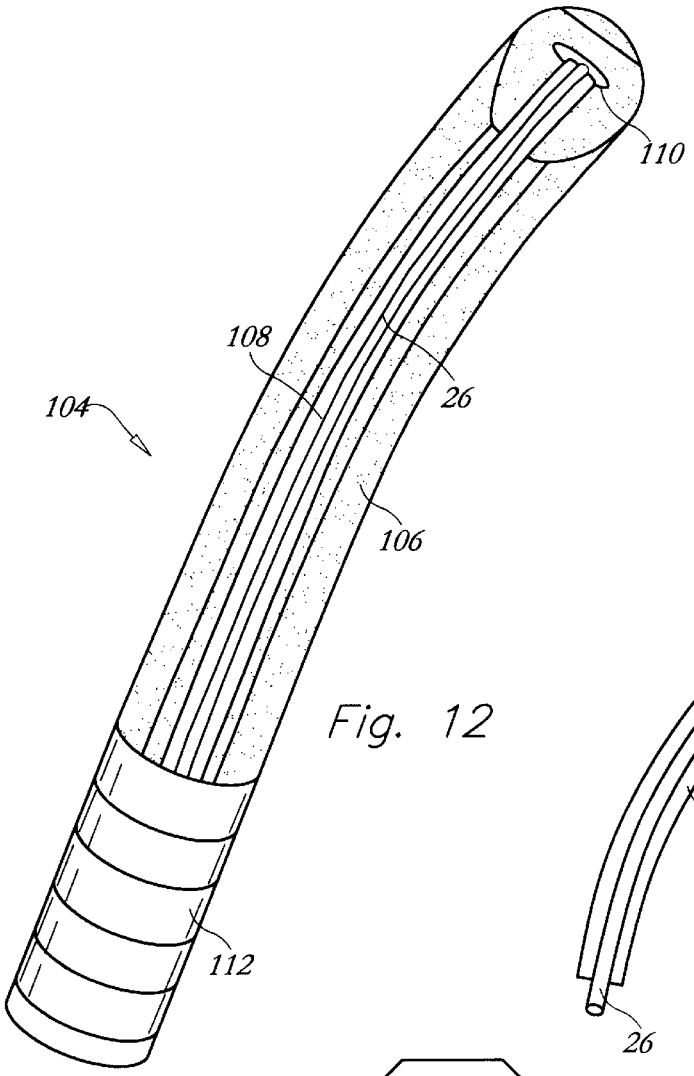
FIG. 12 is a perspective view of a toy embodiment according to the present invention with an alternate attachment method of the powder retentive/dispersive material of FIG. 8A.
Figure 13:
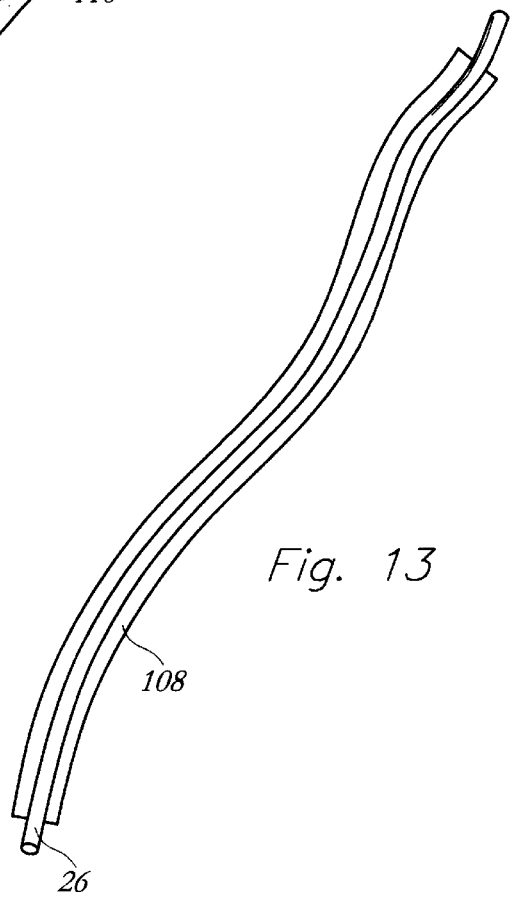
FIG. 13 is a perspective view of the powder retentive/dispersive material of FIG. 8A sewn to a strip of fabric.
Figure 14:
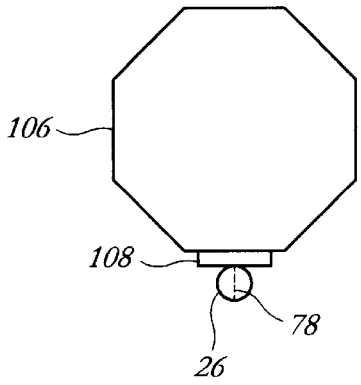
FIG. 14 is a cross sectional view of the toy embodiment of FIG. 12.

An alternate method of attaching powder retentive/dispersive material 26 is shown in another embodiment of the present invention. As shown in FIG. 12 toy embodiment 104 comprises elongated shock absorbing member 106 with stabilizer strip 108 having retentive/dispersive material 26 sewn to its center parallel in relation to its length, as shown in FIGS. 13 and 14. This assembly gives material 26 a foundation that provides stability when strip 108 is attached lengthwise to member 106 with a bonding agent such as but not limited to contact cement, thereby allowing retentive/dispersive material 26 to remain straight and raised, even when met with repeated impacts.

The forward end of strip 108 may be anchored to the angled tip portion of member 106 thru slit 110. The rearward end of strip 108 may be anchored to the rear gripping portion of member 106 by a cloth tape 112 such as but not limited to athletic tape. Tape 112 also serves as a gripping surface.

FIG. 14 illustrates a cross section view of toy embodiment 104 showing a preferred shape of member 106 in the form of an octagon. Also shown is the attachment assembly of retentive/dispersive material 26 sewn to stabilizer strip 108 being bonded to shock absorbing member 106.

Shock absorbing member 106 is preferably made of a compressive/resilient material such as but not limited to a closed cell foam extrusion or an elongated air bladder. Stabilizer strip 108 is preferably made of a lightweight synthetic fabric such as but not limited to nylon.

The present invention and the embodiments thereof provide a unique system and method of hit confirmation by incorporating the ultimate in safety, accuracy, efficiency, and affordability in order to solve the long standing problems that have plagued this field.

Although the invention is illustrated and described herein as embodied in a simulated sword and vest, it is nevertheless not intended to be limited to the details shown, since various modifications and structural changes may be made therein without departing from the spirit of the invention.

We claim:

1. A scoring apparatus for simulated combat between at least two opponents comprising:

(a) a simulated edged weapon having a gripping section and a padded striking section;

(b) a marking agent and a retentive/dispersive cord for dispensing a powder marking agent, said marking agent previously being a solid allowing for controlled amounts of said agent to be directly applied and largely confined to said cord; and (c) means for attaching and aligning said cord to the padded striking section whereby a linear mark is dispensed upon contact of said simulated edged weapon with one of said at least two opponents.

2. The scoring apparatus of claim 1, wherein the solid marking agent is stick chalk.

3. The scoring apparatus of claim 2, wherein the retentive/dispersive cord comprises cotton.

4. The scoring apparatus of claim 3, wherein the padded striking section and the gripping section comprise: a closed cell foam extrusion having a front tip portion and a rear end portion.

5. The scoring apparatus of claim 4, wherein the means for attaching the cotton cord to the padded striking section comprises:

(a) a strip of fabric having two ends;

(b) stitching allowing said cord to be sewn parallel respective to said strip of fabric;

(c) a slit in the front tip portion of the padded striking section through which one of said two ends of fabric is inserted; and (d) a bonding agent whereby said strip is bonded along the padded striking section, said strip and stitching allowing the cotton cord to remain aligned and raised when the padded striking section is met with an impact.

6. The scoring apparatus of claim 3, wherein the padded striking section comprises:

(a) a flat core having a top surface, a bottom surface, a rearward end, and a forward end;

(b) a top padded strip attached to said top surface of the flat core;

(c) a bottom padded strip attached to said bottom surface of the flat core; and (d) means for attaching said flat core perpendicular to the gripping section allowing the striking section to flex during a striking or thrusting action while still giving lateral resistance during a parrying type action.

7. The scoring apparatus of claim 6, wherein the means for attaching and aligning the cord to the striking section comprises:

(a) a striker covering having a closed end and an open end slidable onto the striking section;

(b) stitching whereby said cord is sewn parallel respective to the striker covering; and (c) means for securing said open end of the striker covering to the rear end portion of said striking section.

8. The scoring apparatus of claim 7, wherein the means for securing said open end of the striker covering to the striking section comprises a plurality of threaded holes and screws.

9. The scoring apparatus of claim 2, further comprising: means for readily erasing said linear mark from one of said at least two opponents.

10. The scoring apparatus of claim 9, wherein the means for readily erasing said linear mark comprises:

(a) a nylon body covering allowing said mark to be applied and seen yet not penetrate beyond the immediate surface of said nylon;

(b) a dampening means; and (c) a drying means.

11. The scoring apparatus of claim 10, wherein the nylon body covering comprises a vest.

12. The scoring apparatus of claim 11, wherein the dampening means and the drying means comprises:

an eraser having a sponge portion allowing said mark to be readily wiped away and a felt portion whereby any remaining dampness is quickly dried leaving said nylon vest clean, dry, and ready to receive new marks.

13. The scoring apparatus of claim 2, further comprising a marking agent applicator.

14. The scoring apparatus of claim 13, wherein the marking agent applicator comprises:

(a) a holding section whereby said stick chalk is held upright in a poised position;

(b) a cap section being attachable to the holding section, said cap having a top surface with a groove and a center hole whereby a portion of said chalk stick is exposed, said groove being disposed for guiding said chalk stick along the retentive/dispersive cord whereby said cord is charged with chalk; and (c) means for said cap section to descend down the holding section allowing more of said chalk stick to be revealed after charging said cord.

15. The scoring apparatus of claim 14, wherein the means for said cap section to descend down the holding section comprises said holding section and said cap section being threaded.

16. A scoring apparatus for simulated combat between at least two opponents comprising:

(a) a simulated edged weapon having a gripping section and a rigid blade section;

(b) a marking agent and a cotton cord for dispersing a powder marking agent, said marking agent previously being a solid allowing for a controlled amount of said agent to be directly applied and largely confined to said cord; and (c) means for attaching said cord across an edge of the rigid blade section whereby a linear mark is dispensed upon contact of said simulated edged weapon with one of said at least two opponents.

17. The scoring apparatus of claim 16, wherein the means for attaching the cotton cord to the edge of the rigid blade section comprises:

(a) a groove and at least two passageways allowing the ends of said cord to pass through; and (b) means for securing said cord within the two passageways allowing the cord to be stretched across the edge of the rigid blade section.

18. The scoring apparatus of claim 17, wherein the means for securing the cord within the two passageways comprises at least one threaded hole and at least one screw.

19. A method of scoring during simulated combat between at least two opponents comprising the steps of:

(a) applying a powder marking agent to a retentive/dispersive cord being attached to a simulated edged weapon;

(b) striking said simulated weapon against a nylon body covering worn by at least one of said at least two opponents to simulate a hit by said marking agent; and (c) erasing said marking agent from the nylon body covering.

* * * * *